US005927377A

United States Patent [19]

Peters et al.

[11] Patent Number: 5,927,377

[45] Date of Patent: Jul. 27, 1999

[54] METHOD OF WIPING AND APPLICATION OF MOLD RELEASE SOLUTION TO A ROTARY CHILL CASTING WHEEL

[75] Inventors: Dennis K. Peters, Rock Island; Weston L. Wassell, East Moline, both of Ill.

[73] Assignee: Continuus Properzi S.P.A, Milan, Italy

[21] Appl. No.: 08/873,990

[22] Filed: Jun. 12, 1997

Related U.S. Application Data

[60] Provisional application No. 60/034,542, Jan. 6, 1997.

[51] Int. Cl.[6] ..... B22D 11/06; B22D 11/07

[52] U.S. Cl. ..... 164/472; 164/482; 164/268

[58] Field of Search ..... 164/472, 158, 164/268, 452, 451, 121, 482, 433

[56] References Cited

U.S. PATENT DOCUMENTS

| | | | |
|---|---|---|---|
| 2,747,244 | 5/1956 | Goss . | |
| 3,695,342 | 10/1972 | Petit | 164/433 |
| 3,795,269 | 3/1974 | Leconte et al. . | |
| 4,708,194 | 11/1987 | Mohn . | |
| 4,830,088 | 5/1989 | Miller | 164/472 |
| 4,831,745 | 5/1989 | Brooks et al. . | |
| 5,339,886 | 8/1994 | Key et al. . | |

FOREIGN PATENT DOCUMENTS

| | | |
|---|---|---|
| 57-11753 | 1/1982 | Japan . |
| 1-266947 | 10/1989 | Japan . |

*Primary Examiner*—Kuang Y. Lin
*Attorney, Agent, or Firm*—Richard C. Litman

[57] ABSTRACT

Automatic and manual methods of wiping and applying a mold release solution to a rotary chill casting wheel, which eliminate the problems of improper manual application of mold release fluids and the inadequate cleaning of the casting wheel due to lateral and elliptical displacement of the rotating casting ring mold. The mold is wiped with a combination of felt pads during a casting run. The mold is lubricated with a mold release fluid from an atomizer assembly, which accurately deposits the lubricant fluid to encompass the entire casting surface of the rotary chill casting wheel surface while the casting wheel rotates, before introduction of the metal melt.

16 Claims, 7 Drawing Sheets

METHOD OF WIPING AND APPLICATION OF MOLD RELEASE SOLUTION TO A ROTARY CHILL CASTING WHEEL

CROSS-REFERENCE TO RELATED APPLICATION

This application claims the benefit of U.S. Provisional Patent Application Serial No. 60/034,542, filed Jan. 6, 1997.

FIELD OF THE INVENTION

The present invention relates to a method of automatically or manually wiping the residue of mold release solution left after a casting run and the automatic and accurate application of a mold release solution to a rotary chill casting wheel prior to a subsequent continuous casting run.

DESCRIPTION OF RELATED ART

In addition to the uniform application of cooling water to the non-casting external surfaces of a vertically disposed rotary chill casting wheel, uniform application of the mold release solution required to prevent sticking of molten metal, e.g., aluminum alloy, to the casting surfaces of the copper alloy ring mold is a very important consideration relative to the quality of the continuously cast bar produced and general service life of such a copper alloy ring mold. To avoid problems with the aluminum alloy bar sticking to the casting wheel and isolated mold areas overheating, rotary chill casting wheels are normally equipped with a single box or a series of sturdy hollow boxes that are installed directly over the profile which is machined about the copper ring circumference. Such hollow boxes are used for the installation of tightly packed cloth wipers which have lubricant applied to the wiper surfaces which contact the ring mold. Such mold wipers are generally installed in a manner that require that they be packed tightly into position by means of a hammer and stick or similar devices.

Because the hollow boxes used for containing the tightly packed wipers are attached to the casting machine in a rigid manner, lateral and/or elliptical displacement of the ring mold cause the wipers to be tight against one or more inside surfaces of the ring mold periphery and correspondingly loose in others. When this problem occurs, portions of the casting wheel receive correspondingly more or less mold release solution than others aggravating the problem. Because the mold release solution serves as an insulator between the solidifying aluminum alloy and the copper alloy casting wheel, the non-uniform application of the mold release results in an irregular cooling temperature and poorer quality of the continuously cast bar. This problem of the prior art method should not be tolerated, and is solved by implementing the present invention. The prior art fails to address the problem, which results in waste and poorer quality of product.

The following related art is discussed in the order of its relevance to the present invention.

Japan Patent No. 57-11753 issued on Jan. 21, 1982, to Kiyoshi Shibuya describes the use of a graphite containing powder in a lubricant composed of mineral oil, vegetable oil and/or animal oil to the surface of two pinch rolls to increase the life of the rolls in the continuous manufacturing of aluminum bars. The sequential treatment consists of spraying a first quantity of lubricant to each roll after chill casting to lower the roll temperature, wiping off the excess oil, spraying a second quantity of lubricant, and leveling the applied lubricant with an air blast before the rolls come into contact with the molten aluminum stream. Another embodiment utilizes only one application of lubricant to each roll from a lubricant bath with a roller applicator and subsequently wiping. There is no suggestion for wiping the casting rolls before the lubricant is added.

Japan Patent No. 1-266947 issued on Oct. 24, 1989, to Naotada Yoshida describes a method for continuously casting a metal strip having a uniform thickness from a bath of molten metal with a water-cooled roll. Two pinch rolls pull up the metal strip, a wiper means cleans the casting roll surface, and then silicone oil is sprayed on the roll from a nozzle to produce a uniform metal layer or shell. The purpose of the lubricant is not to protect the casting roll surface, but to enable the production of a uniform layer or shell of metal going to the pinch rolls.

U.S. Pat. No. 4,831,745 issued on May 23, 1989, to William H. Brooks et al. describes a method of reducing residual moisture on caster rolls by placing a controllable heat source in close proximity to the top and bottom rolls of the caster to evaporate the residual moisture from the roll surface. The lubricant is not an oil lubricant but an aqueous composition.

U.S. Pat. No. 5,339,886 issued on Aug. 23, 1994, to James C. Key et al. describes a method and apparatus for trimming edge scrap from a continuously cast metal strip. The operation of a prior art apparatus is described as cleaning the vertical casting wheel with a rotary brush and then applying heat from a burner before contacting the melt from a tundish. In an alternative embodiment, the inscribing tool applied after casting to the metal strip can instead be a sprayed-on coating material such as graphite, plastic, or Teflon(TM) (polytetrafluoroethylene) in an elongated form to produce a line coating. However, there is no suggestion for applying any lubricant to the molding surface.

U.S. Pat. No. 4,708,194 issued on Nov. 24, 1987, to Walter R. Mohn, describes a method and apparatus for rapidly solidifying metal by employing one or more metallic conditioning brushes on a vertical casting wheel. The pressure of the copper-zinc-nickel brushes is adjusted so as to deposit a layer of the brush metal onto the copper casting surface, so that the layer increases the quality of the resulting cast material. There is no suggestion for adding a liquid lubricant to the molding surface.

U.S. Pat. No. 3,795,269 issued on Mar. 5, 1974, to Gerard B. Leconte et al. describes a method and apparatus for casting aluminum on moving steel surfaces such as parallel belts or drums. The ingot is coated on both sides with a parting layer of powdered talc or carbon mixed with an insulative coating of silicone oil. The coatings are added to the endless belts or drums prior to casting. The casting surfaces are then cleaned with stainless steel brushes and a vacuum source before adding the next coating. There is no suggestion for wiping and adding lubricant as in the present invention.

U.S. Pat. No. 2,747,244 issued on May 29, 1956, to Norman P. Goss describes a porous vertical mold for the continuous casting of aluminum. The mold comprises an outer mold layer of either copper or aluminum and a specialized porous inner sleeve preformed from either graphite, boron carbide, carborundum or beryllium oxide mixed with tar and fired. Then a lubricant such as either SAE 20 machine oil, paraffin oil or palm oil mixed with colloidal graphite (5–10% by volume) is fed through the porous vertical mold to contact the cooling aluminum ingot in situ. Cooling water is sprayed on the issuing ingot. There is no suggestion for wiping and adding lubricant to the casting mold before the metal melt contacts the mold surface.

None of the above inventions and patents, taken either singularly or in combination, is seen to describe the instant invention as claimed. Thus, a method of wiping and application of mold release solution to a rotary chill casting wheel solving the aforementioned problems is desired.

SUMMARY OF THE INVENTION

The present invention is either an automatic or manually operated method of wiping and applying a mold release solution to a rotary chill casting wheel which eliminates the problems of improper manual application of mold release fluids and the inadequate cleaning of the casting wheel due to lateral and elliptical displacement of the rotating casting ring mold. The mold is wiped (automatic or manual operation) with a combination of felt pads during a casting run. The mold is lubricated (automatic or manual operation) with a mold release fluid from atomizer assemblies which accurately deposit the lubricant fluid while the casting wheel rotates before casting the metal melt.

Accordingly, it is a principal object of the invention to provide a method of wiping and application of a mold release solution to a rotary chill casting wheel.

It is another object of the invention to provide either an automatic or manual method of wiping the residue of mold release solution left during a casting run with a wiper box containing at least two separate wiping pads of different dimensions.

It is a further object of the invention to provide an accurate automatic or manual application of a mold release solution to a rotary chill casting wheel after wiping and prior to and during another casting run.

Still another object of the invention is to provide a wiping system which is not attached to the casting machine, therefore eliminating the effect of any lateral and/or elliptical displacement of the ring mold when utilizing the present wiping system.

It is an object of the invention to provide improved elements and arrangements thereof in a method of wiping and application of mold release solution to a rotary chill casting wheel for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention provides a method of either manually or automatically operated wiping of the residue of mold release solution left during a casting run of a rotary chill casting wheel or ring mold, and either the automatic or manual application of mold release solution to a rotary chill casting wheel prior to and during a casting run. By "manual operation", it is meant that the application periods of wiping and solution wetting or lubrication are determined manually by observation and not the physical application by hand. "Automatic operation" involves the use of a computer for programming the sequence and movement in and out of the mold wiper element as well as the ejection of the lubricant solution from the nozzles of the lubricator element.

Figure 1:
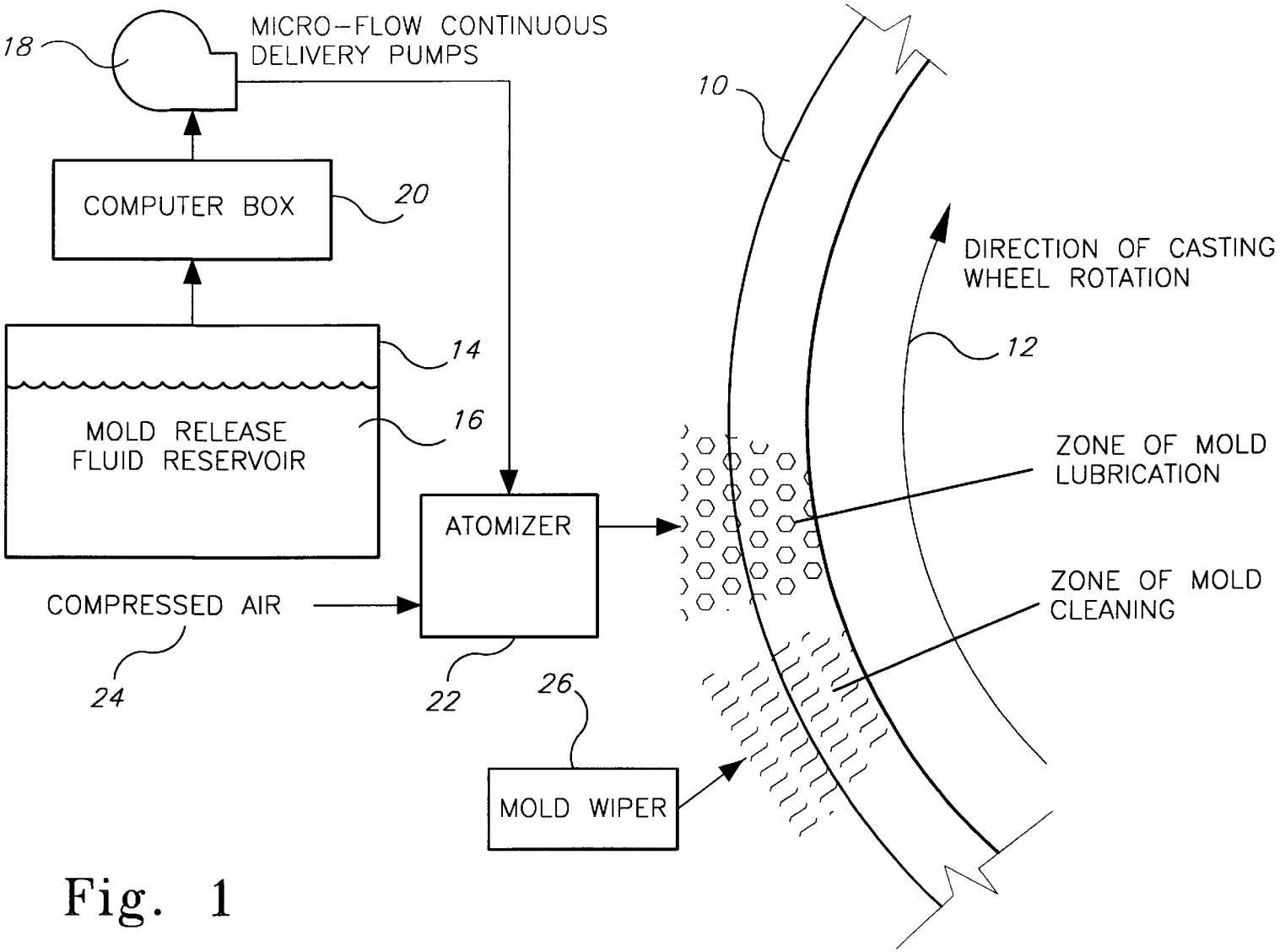
FIG. 1 is a schematic diagram of either an automatic or manually operated method of wiping and applying a mold release solution to a rotary chill casting wheel according to the present invention.

FIG. 1 is a schematic diagram of the physical arrangement of the lubrication and wiping process for a chill casting wheel or ring mold 10 shown partially rotating in a direction 12. A mold release fluid reservoir 14 containing a lubricant solution 16 delivers the solution to micro-flow delivery pumps 18 on command of the computer in the computer box 20. For manual control the computer system is not necessary. The pumped lubricant solution 16 is piped to the atomizer or lubricator element 22 where the zone of mold lubrication is shown by the hexagonal pattern. The computer box 20 also controls the issuance of compressed air 24 to the lubricator element 22 resulting in the spraying of the lubricator solution 16 to wet the mold surface of the rotary chill casting wheel or mold 10 at the zone of mold lubrication. The movement of the mold wiper element 26 into the mold 10 occurs at the zone of mold cleaning shown by the curved lines. The process involves the wiping of any residue resulting from the continuous casting by mold wiper element 26 and the subsequent wetting of the mold surface by the atomizer or lubricator element 22 in preparation for the metal melt being deposited in the rotary chill casting wheel mold 10.

Figure 2:
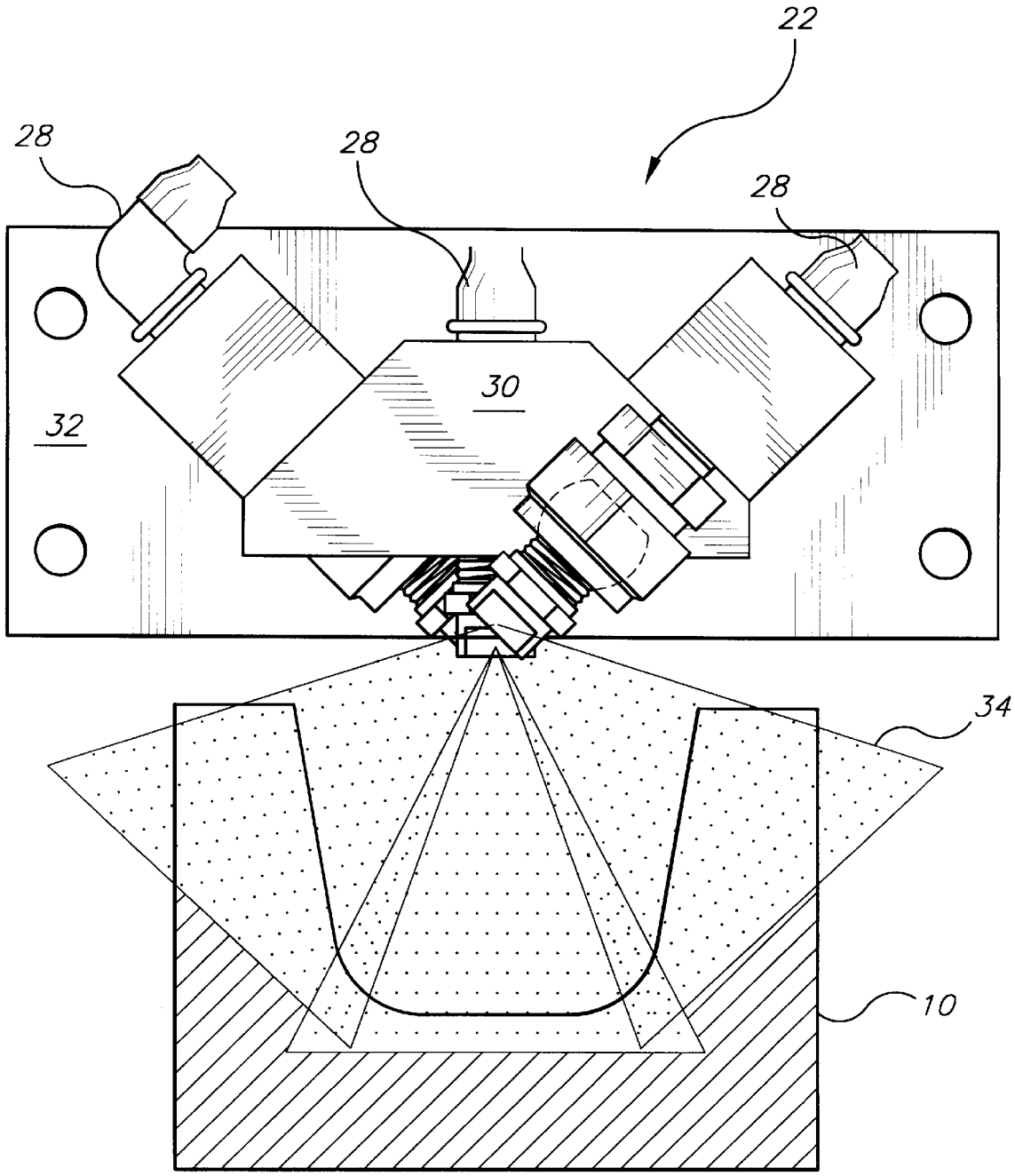
FIG. 2 is a front view of an individual nozzle assembly spraying a cross-section of the casting wheel.
Figure 3:
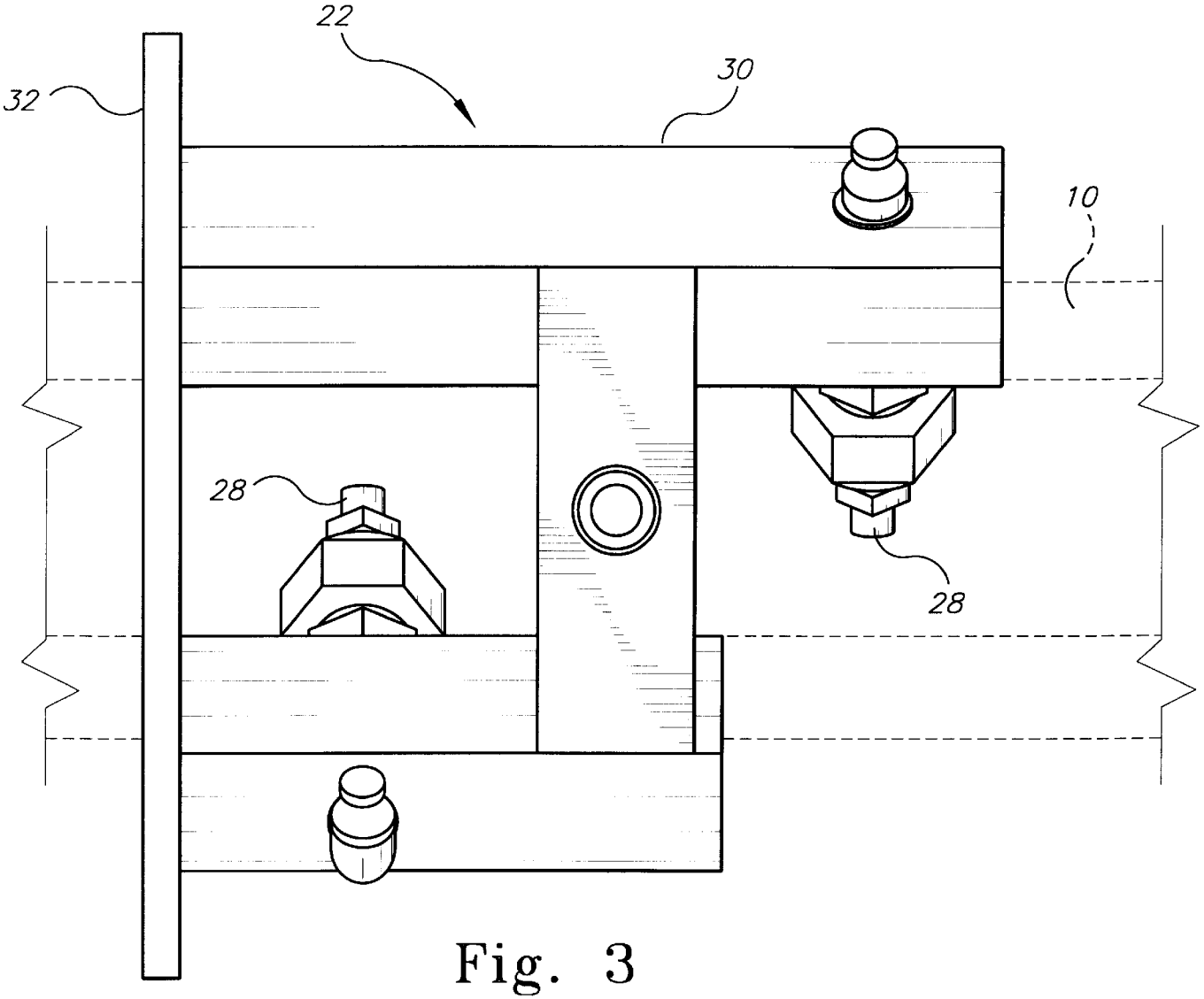
FIG. 3 is a top plan view of the FIG. 2 apparatus over the casting wheel.
Figure 4:
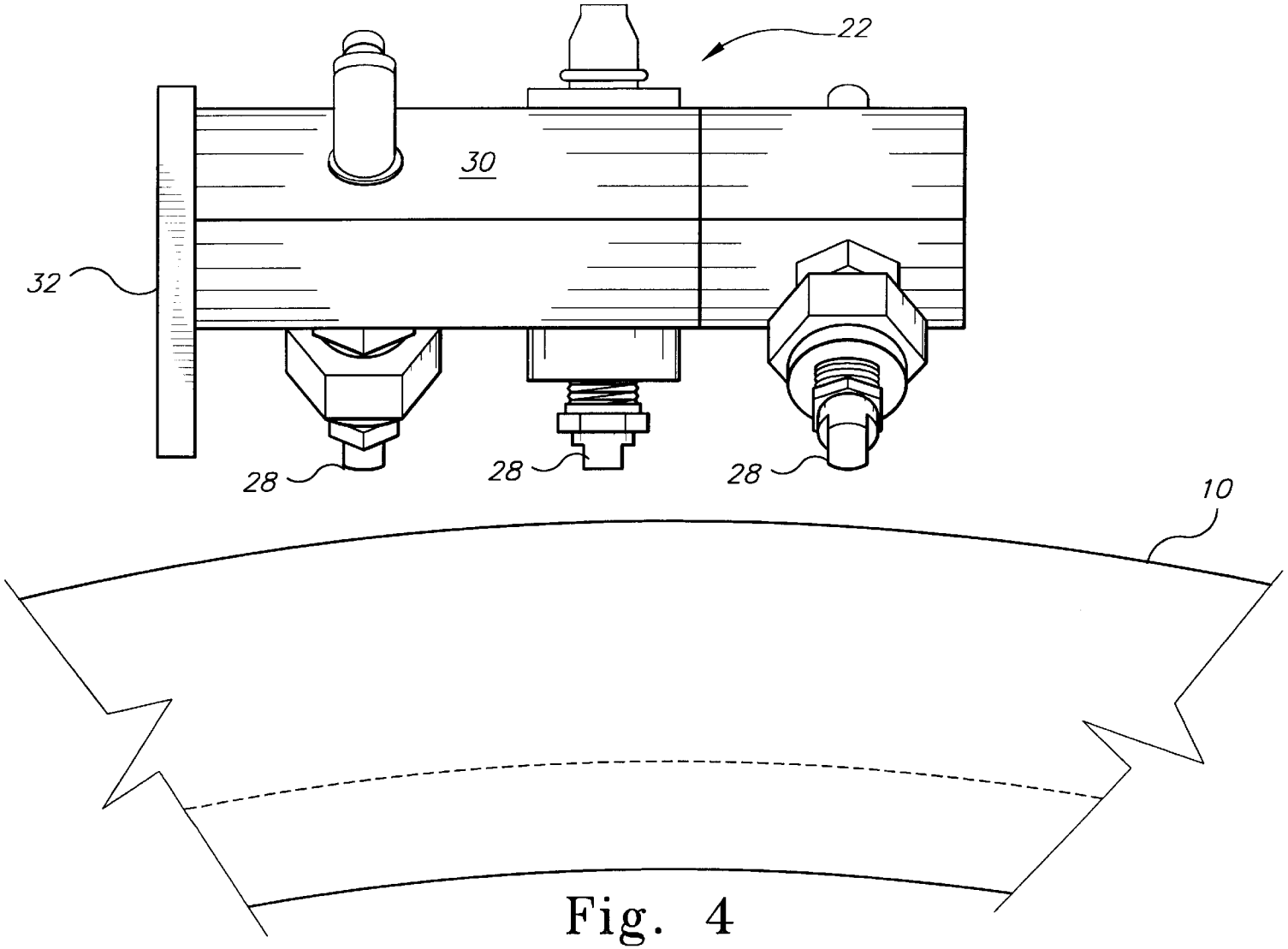
FIG. 4 is an end view of the nozzle assembly of FIG. 2 with the casting wheel.
Figure 5:
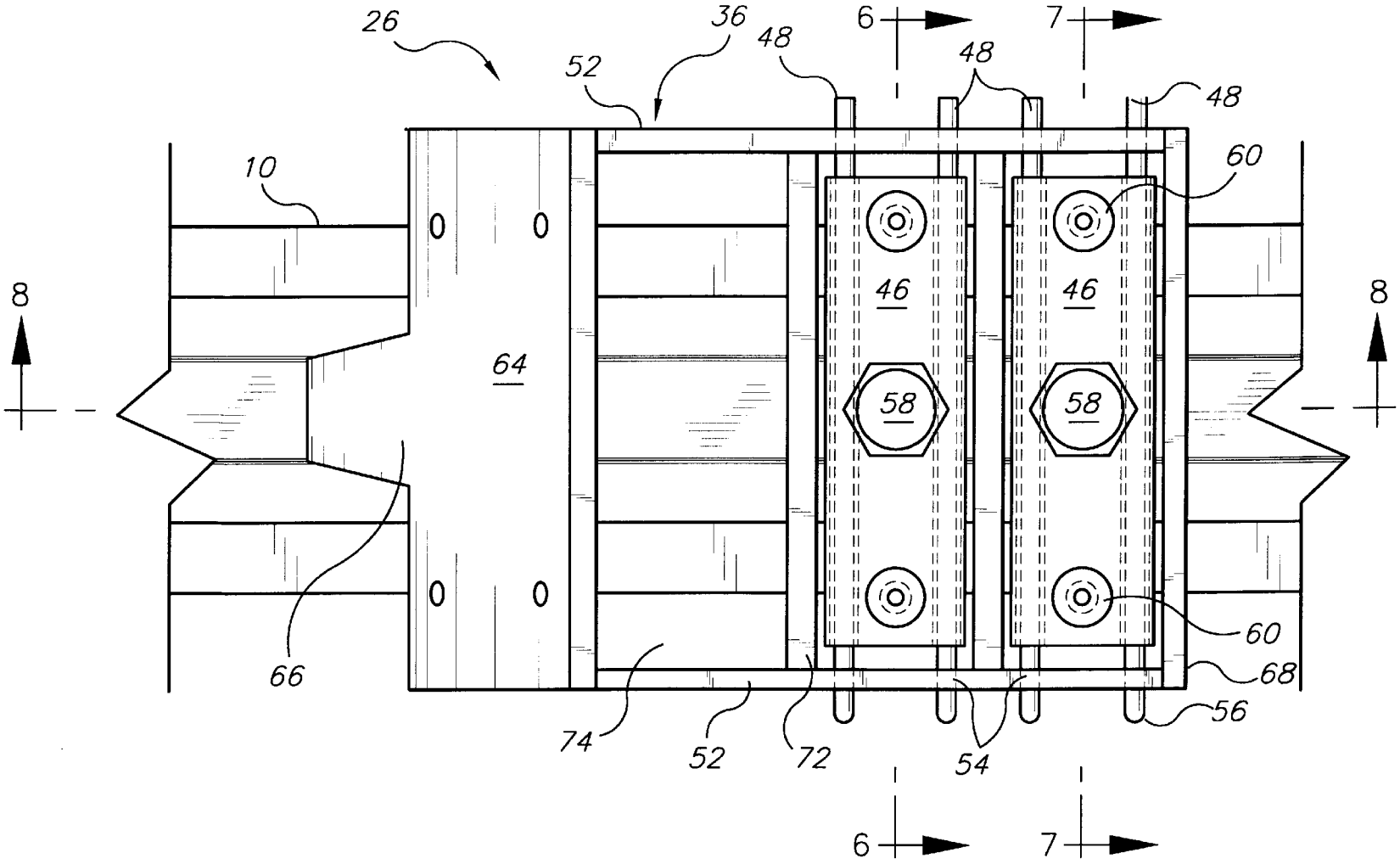
FIG. 5 is a plan view of the wiper assembly over a casting wheel.
Figure 7:
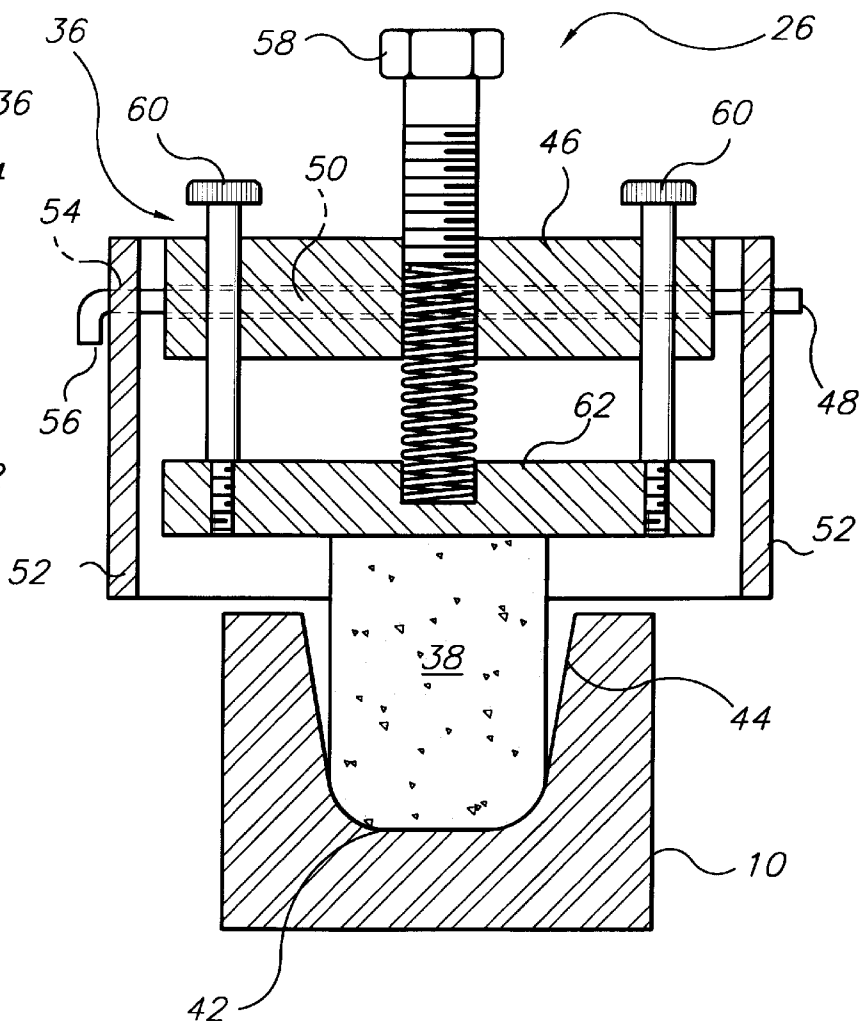
FIG. 7 is a sectional view along line 7—7 of the FIG. 5 wiper assembly.

Turning to FIGS. 2–4, the atomizer or lubricator element 22 is depicted with three atomizers or spray nozzles 28 positioned in various positions on a mount 30 which is supported by a bracket 32 on a frame (not shown) separate from the frame supporting the rotary chill casting wheel 10. The overlapping spray pattern 34 by three spray nozzles shown in FIG. 2 is exemplary in that the present invention encompasses the use of only two atomizers 22, depending on the configuration of the mold surface. Although FIGS. 2–4 show a fixed mounting of the spray nozzles 28, it is contemplated to swivel mount the outside nozzles for flexibility in the adjustment of the spray pattern 34.

Figure 6:
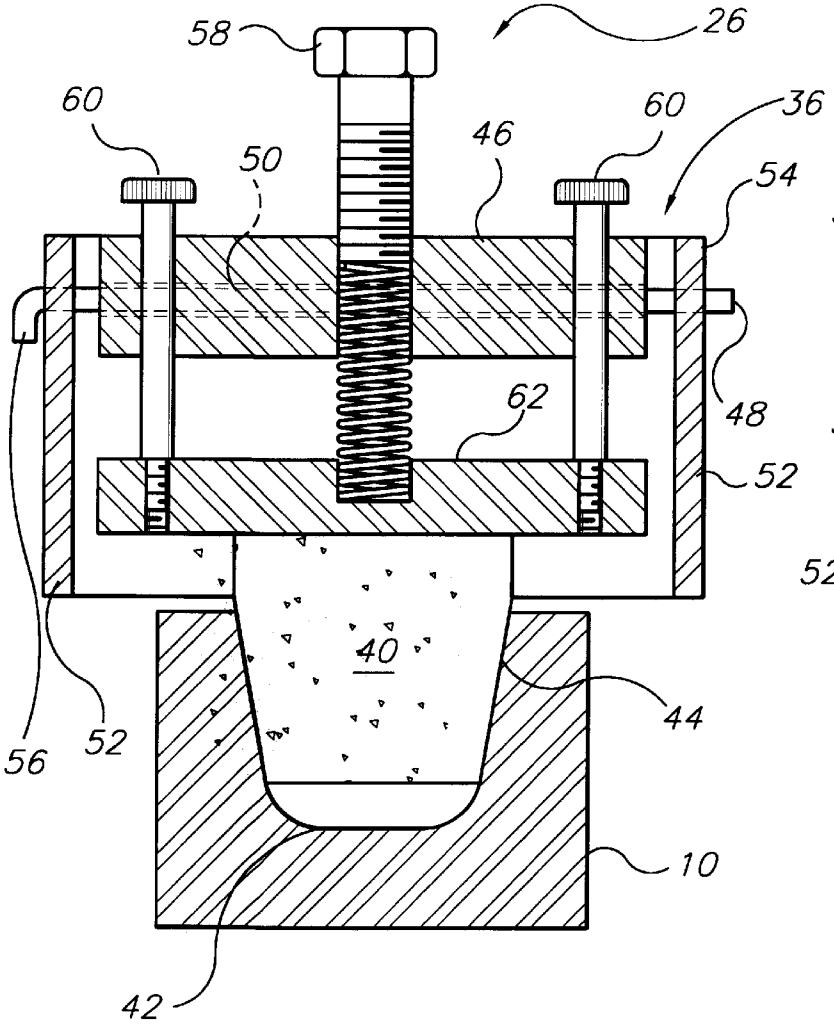
FIG. 6 is a sectional view along line 6—6 of the FIG. 5 wiper assembly.
Figure 8:
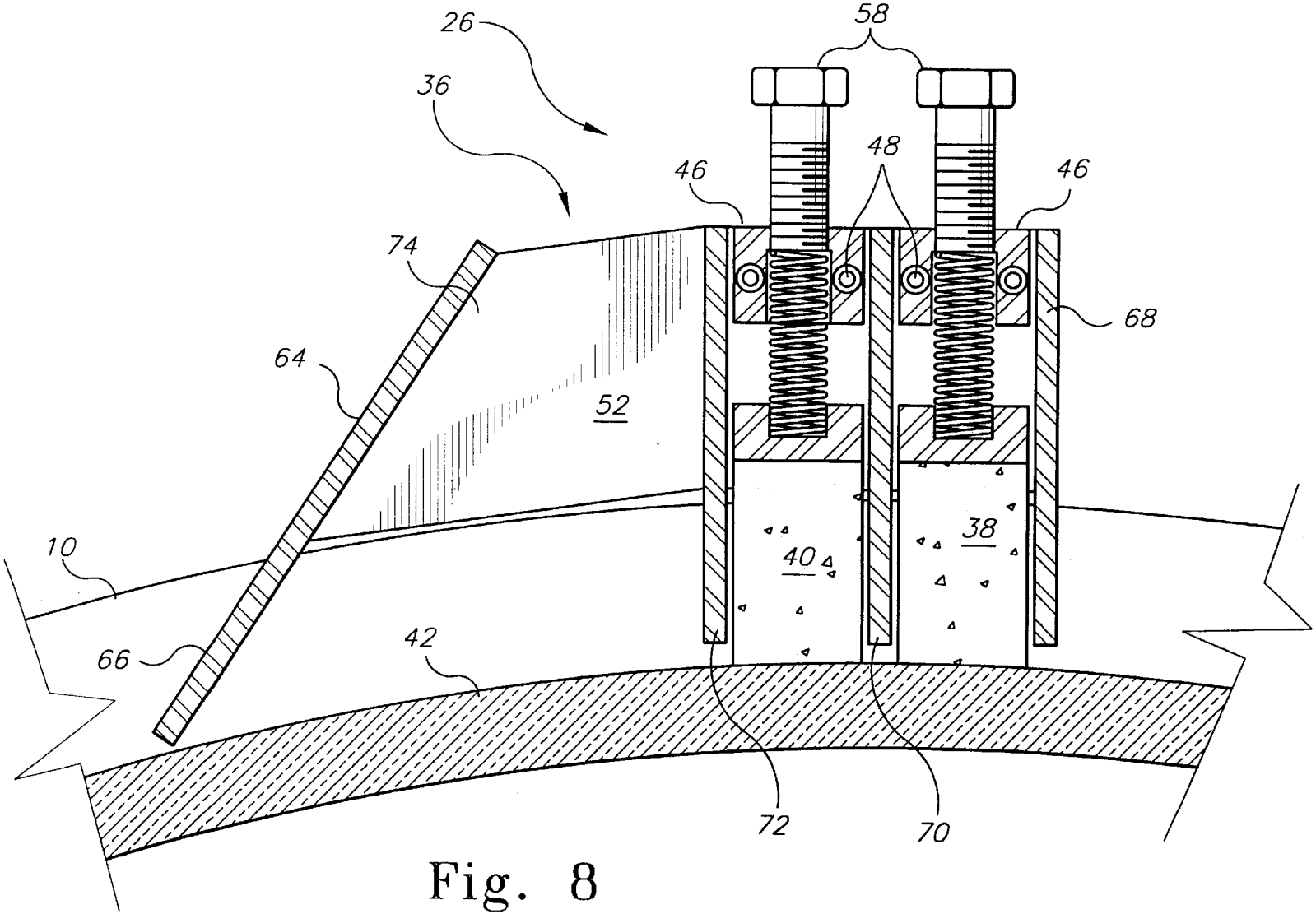
FIG. 8 is a sectional view along line 8—8 of the FIG. 5 wiper assembly.

Turning to FIGS. 5–8, the mold wiper element 26 is shown in detail. The wiping system is not attached to the casting machine, thereby eliminating the effect of any lateral effect and/or elliptical displacement of the ring mold when utilizing the present wiping system. A wiper frame 36 contains a first felt wiper pad 38 (FIG. 7) and a second felt wiper pad 40 (FIG. 6). The wiper pads have different shapes in order to efficiently scour the entire inside surface of the chill casting mold 10. First pad 38 contacts the bottom surface 42 but not the side surfaces 44, whereas the second pad 40 contacts the side surfaces 44, but not the bottom surface 42. By this method a more accurate cleaning of the inside surfaces of the ring mold 10 is accomplished.

The pads are held in the wiper frame 36 by a hanger plate 46 supported by a pair of hanger pins 48 traversing the hanger plate through the hanger plate throughbores 50 and the sides 52 of the wiper frame 36 through the sidewall throughbores 54. One end of the hanger pin 48 ends in a bend 56 to facilitate removal. The hanger plate 46 supports a retainer bolt 58 which is located between a pair of guide pins 60. The guide pins 60 secure a wiper support plate 62. The felt wiper pads 38 and 40 are attached to the wiper support plates 62. The retainer bolt 58 abuts a spring 60 which is seated in the wiper support plate 62. Therefore, by this means, the automatic seating of the respective wiper pad can be performed before and during the casting run as the pads wear.

The apertured end wall 64 of the wiper frame 36 is conveniently shaped with a tail 66 to aid in maintaining the wiper frame 36 in the ring mold 10. The front wall 68 and the inner walls 70 and 72 of the wiper frame 36 also have the same configuration as the tail 66 of the end wall 64. As is evident from the space 74 available in the wiper frame 36, another wiping element can be inserted in the space 74.

The present invention improves the cleaning and lubrication of the rotary chill casting wheel 10, and consequently improves the quality of the resulting cast metal by the use of one lubricator element 22 and at least two wipers in the mold wiper element 26.

It is to be understood that the present invention is not limited to the embodiments described above, but encompasses any and all embodiments within the scope of the following claims.

We claim:

1. A method of wiping and applying a mold release solution to a rotary chill casting wheel during a metal casting process to produce a solidified metal product, the method comprising:

a wiping step including the complete wiping of any residue of mold release solution left on a revolving rotary chill casting wheel mold, with a mold wiper element containing at least two differently shaped wiper pads which cover the casting surface; and a lubrication step, including the application of a solution of mold release solution immediately subsequently to the wiping step, from a lubricator element containing multiple spray nozzles spraying in a predetermined spray pattern which wets the entire mold surface contacting the solidifying metal;

whereby the resulting solidified metal product issuing from the rotary casting wheel is substantially devoid of imperfections due to non-uniform cooling and the rotary casting wheel has minimum deterioration of the casting surface.

2. The method according to claim 1, wherein the mold wiper element contains a first wiper pad, contacting a bottom surface of the rotary chill casting wheel, and a second wiper pad, contacting both inclined wall surfaces of the rotary chill casting wheel surface.

3. The method according to claim 2, wherein the first wiper pad has a rectangular shaped cross-section with a width adapted for completely contacting the bottom surface of the chill casting mold.

4. The method according to claim 2, wherein the second wiper pad has a cross-section shaped for contacting only the sides of the chill casting mold.

5. The method according to claim 1, wherein the lubricator element provides uniform lubrication of the casting surface and includes at least two spray nozzles directed for wetting the casting surface.

6. The method according to claim 1, wherein the lubricator element provides uniform lubrication of the casting surface and includes a spray nozzle directed for wetting a bottom surface, a spray nozzle for wetting one side surface, and a spray nozzle for wetting an opposite side surface of the rotary chill casting wheel mold.

7. The method according to claim 6, wherein the spray nozzles are fixed in position.

8. The method according to claim 6, wherein the spray nozzles are swivel mounted for manual adjustment of lubrication coverage.

9. The method according to claim 1, wherein application periods for the wiping step and the lubrication step are determined manually by observation.

10. The method according to claim 1, wherein application periods for the wiping step and the lubrication step are determined automatically by a programmed, all purpose digital computer.

11. The method according to claim 1, wherein a computer is programmed to control the sequence and movement in and out of the mold wiper element.

12. The method according to claim 1, wherein a computer is programmed to control the ejection of the mold, release solution from the lubricator element containing multiple spray nozzles.

13. The method according to claim 1, wherein the wiper pads are felt pads, for complete, efficacious wiping.

14. The method according to claim 1, wherein the wiper element is maintained separately from the rotary chill casting wheel, for eliminating any lateral and elliptical displacement of said wheel.

15. The method according to claim 1, wherein the metal casting process is the continuous casting of an aluminum rod.

16. The method according to claim 1, wherein the wiper pads are automatically seated during the metal casting process.

* * * * *